US006044822A

United States Patent [19]

Daniels

[11] Patent Number: 6,044,822

[45] Date of Patent: Apr. 4, 2000

[54] PROGRAMMED BREAK-IN MODE FOR TWO-CYCLE ENGINE

[75] Inventor: John M. Daniels, Round Lake Beach, Ill.

[73] Assignee: Outboard Marine Corporation, Waukegan, Ill.

[21] Appl. No.: 09/198,791

[22] Filed: Nov. 24, 1998

Related U.S. Application Data

[63] Continuation of application No. PCT/US97/10463, Jun. 16, 1997.

[60] Provisional application No. 60/016,089, Jun. 21, 1996.

[51] Int. Cl.[7] ..... F01M 1/00; F01M 3/00

[52] U.S. Cl. ..... 123/196 R; 123/73 AD; 184/6.1

[58] Field of Search ..... 123/73 AD, 196 R, 123/196 W; 184/6.4, 6.1, 26

[56] References Cited

U.S. PATENT DOCUMENTS

| | | | |
|---|---|---|---|
| 4,480,602 | 11/1984 | Kobayashi et al. | 123/73 AD |
| 4,531,485 | 7/1985 | Murther | 123/196 S |
| 5,526,783 | 6/1996 | Ito et al. | 123/196 S |
| 5,597,051 | 1/1997 | Moriya et al. | 184/6.1 |
| 5,630,383 | 5/1997 | Kidera et al. | 123/73 AD |
| 5,829,401 | 11/1998 | Masuda | 123/179.25 |

FOREIGN PATENT DOCUMENTS

| | | | |
|---|---|---|---|
| 0381162 | 8/1990 | European Pat. Off. | 123/73 AD |

*Primary Examiner*—Noah P. Kamen
*Assistant Examiner*—Hai Huynh
*Attorney, Agent, or Firm*—Fletcher, Yoder & Van Someren

[57] ABSTRACT

An automatic and initial adjustment of pertinent engine parameters to provide an engine with a gentle break-in period. The engine's electronic control unit adjusts the engine parameters most conducive to proper break-in during operating speeds greater than a predetermined speed and for a predetermined period of break-in time.

13 Claims, 1 Drawing Sheet

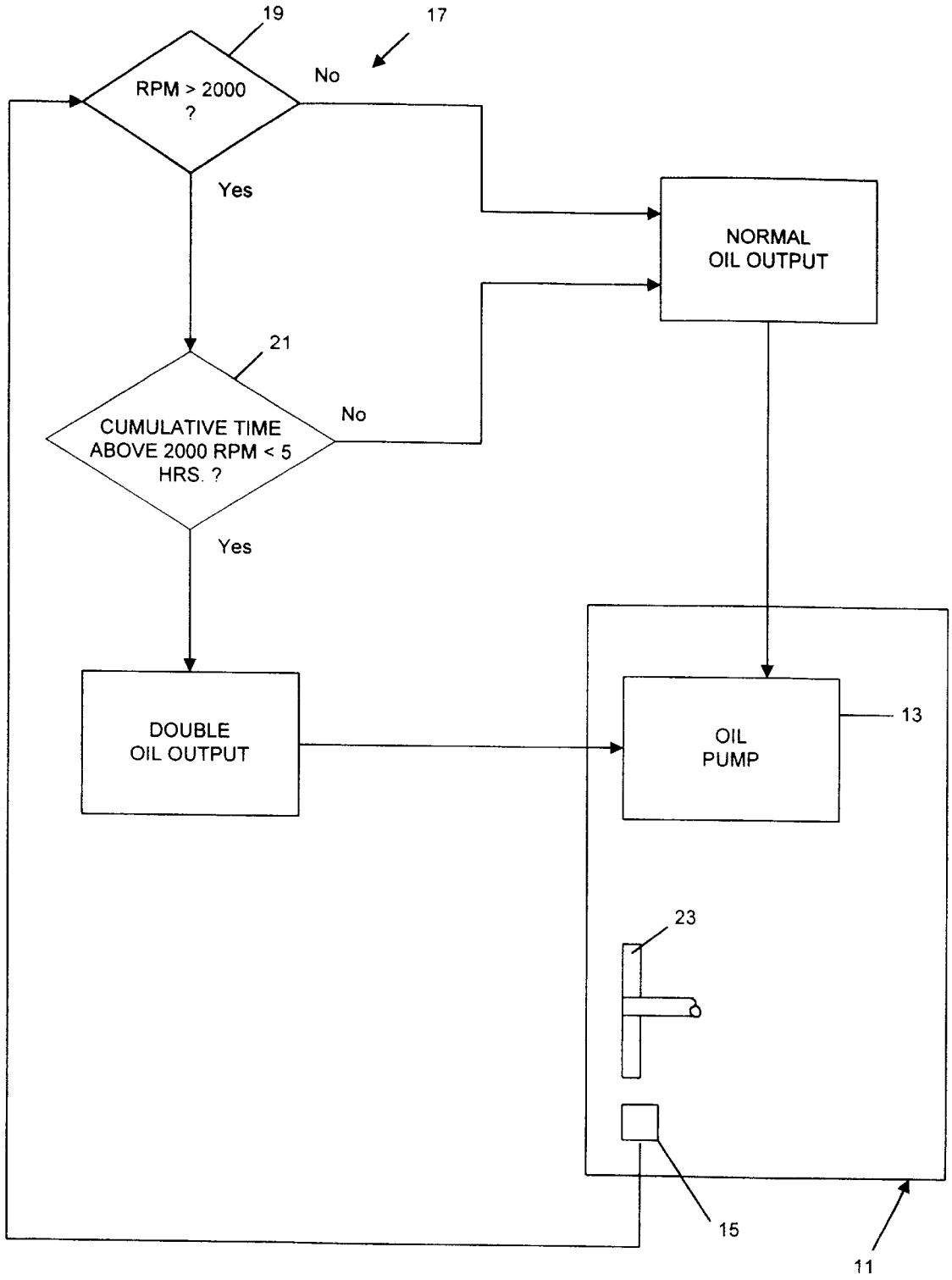
19
17
RPM > 2000 ?
No
Yes
NORMAL OIL OUTPUT
21
CUMULATIVE TIME ABOVE 2000 RPM < 5 HRS. ?
No
Yes
DOUBLE OIL OUTPUT
OIL PUMP
13
23
15
11

PROGRAMMED BREAK-IN MODE FOR TWO-CYCLE ENGINE

CROSS-REFERENCES TO RELATED APPLICATIONS

This application is a continuation of copending International Application Ser. No. PCT/US97/10463, filed Jun. 16, 1997 claiming the benefit of U.S. Provisional Application Ser. No. 60/016,089, filed Jun. 21, 1996.

BACKGROUND OF THE INVENTION

The invention relates generally to internal combustion engines and, more particularly, to break-in modes for such engines.

It is known that a "break-in" period is advantageous to the proper operation and potential life expectancy of a two-cycle engine. Upon initial start-up of a newly built two-cycle engine, certain components require a chance to property "seat" (i.e., rings). The shape of the piston changes once thermally stressed. Likewise, the shape of a cylinder bore changes configuration once thermally stressed. Various engine parameters can influence the extent of these initial "distortions". Engine ignition timing, fueling levels, and oiling delivery all have an effect on the successful wear-in tendencies of an engine.

The ability to control these parameters has traditionally been a manual operation (changing carb jets, adjusting timing manually, increasing oil, fuel ratio, etc.).

SUMMARY OF THE INVENTION

The invention provides a method of operating an internal combustion engine during break-in, which method comprises the steps of providing an engine component capable of operation under a first rate or condition and under a second rate or condition, determining whether the engine is operating above or below a predetermined speed, determining the cumulative time of engine operation above the predetermined speed, operating the engine component at the second rate or condition during a predetermined initial period of engine operation at speeds above the predetermined speed, and operating the engine component at the first rate or condition either when the engine is operating at speeds below the predetermined speed, or, after the predetermined initial period of engine operation at speeds above the predetermined speed.

The invention also provides a method of operating an internal combustion engine during break-in, which method comprises the steps of providing an engine component capable of operation at a normal rate and at an increased rate, determining whether the engine is operating above or below idle speed, determining the cumulative time of engine operation above idle speed, operating the engine component at the increased rate during a predetermined initial period of engine operation at speeds above idle speed, and operating the engine component at the normal rate either when the engine is operating at speeds below idle speed, or, after the predetermined initial period of engine operation at speeds above idle speed.

The invention also provides a method of operating an oil pump to deliver oil to an internal combustion engine during break-in, which method comprises the steps of providing an oil pump capable of operation so as to deliver oil to the engine at a normal oil delivery rate and at an increased oil delivery rate, determining whether the engine is operating above or below idle speed, determining the cumulative time of engine operation above idle speed, operating the oil pump to deliver oil to the engine at the increased oil delivery rate during a predetermined initial period of engine operation at speeds above idle speed, and operating the oil pump to deliver oil to the engine at the normal oil delivery rate either when the engine is operating at speeds below idle speed, or, after the predetermined initial period of engine operation at speeds above idle speed.

In one embodiment of the invention, the step of determining whether the engine is operating above or below a predetermined speed includes the steps of detecting engine speed, and determining whether engine speed is above or below the predetermined speed.

The invention also provides an internal combustion engine comprising an engine component capable of operating under a first rate or condition and under a second rate or condition, a sensor operable to detect engine speed, and an electronic control connected to the engine component and to the sensor, operable to operate the engine component at the second rate during a predetermined initial period of engine operation at speeds above a predetermined speed, and to operate the engine component at the first rate either when the engine is operating at speeds below the predetermined speed, or, after the initial predetermined period of engine operation at speeds above the predetermined speed, and including a comparator operable to determine whether engine speed is above or below the predetermined speed, and a counter operable to determine the cumulative time of initial engine operation above the predetermined speed.

The invention also provides an internal combustion engine comprising an engine component capable of operating at a normal rate and at an increased rate, a sensor operable to determine engine speed, and an electronic control connected to the engine component and to the sensor, operable to operate the engine component at the increased rate during a predetermined initial period of engine operation at speeds above idle speed, and so as to operate the engine component at the normal rate either when the engine is operating at speeds below idle speed, or, after the initial predetermined period of engine operation at speeds above idle speed, and including a comparator operable to determine whether engine speed is above or below idle speed, and a counter operable to determine the cumulative time of initial engine operation above idle speed. The invention also provides an internal combustion engine comprising an oil pump capable of operating so as to deliver oil to the engine under a normal oil delivery rate and at an increased oil delivery rate, a sensor operable to detect engine speed, and an electronic control connected to the oil pump and to the sensor, and operable to operate the oil pump to deliver oil to the engine at the increased oil delivery rate during a predetermined initial period of engine operation at speeds above idle speed, and to operate the oil pump to deliver oil to the engine at the normal oil delivery rate either when the engine is operating at speeds below idle speed, or, after the initial predetermined period of engine operation at speeds above idle speed, and including a comparator operable to determine whether engine speed is above or below idle speed, and a counter operable to determine the cumulative time of initial engine operation above idle speed.

In one embodiment of the invention, the predetermined speed is idle speed, and idle speed is about 2000 RPM.

In one embodiment of the invention, the initial time of engine operation is about 5 hours.

In one embodiment of the invention, the increased rate is twice the normal rate.

In one embodiment of the invention, the engine component is an oil pump.

BRIEF DESCRIPTION OF THE DRAWINGS

These and other features of the present invention will be more fully disclosed when taken in conjunction with the following DETAILED DESCRIPTION OF THE PREFERRED EMBODIMENT(S) in which like numerals represent like elements and in which:

The FIGURE is a diagrammatic view of an internal combustion engine and accompanying electronic control which incorporate various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DETAILED DESCRIPTION OF THE PREFERRED EMBODIMENT(S)

Shown diagrammatically in the FIGURE is an internal combustion engine 11 comprising an engine 13 component capable of operating under a first rate or condition and under a second rate or condition, a sensor 15 operable to detect engine speed, and an electronic control 17 which is connected to the engine component 13 and to the sensor 15, which is operable so as to operate the engine component 13 at the second rate during a predetermined initial period of engine operation at speeds above a predetermined speed, and so as to operate the engine component at the first rate either when the engine is operating at speeds below the predetermined speed, or, after an initial predetermined period of engine operation at speeds above the predetermined speed, and including a comparator 19 which is connected to the sensor 15 and which is operable to determine whether engine speed is above or below the predetermined speed, and a counter 21 which is connected to the comparator 19 and which is operable to determine the cumulative time of initial engine operation above the predetermined speed.

Any suitable sensor which is capable of detecting the rotational speed of an engine component, such as a flywheel 23, can be employed. In addition, any suitable counter can be employed. Furthermore, any suitable electronic control construction can be employed.

While other constructions can be employed in the construction shown in the FIGURE, the engine component 13 is an oil pump which is operable at a first or normal rate of oil delivery to the engine and a second or increased rate of oil delivery to the engine. While other ranges could be employed, in the construction shown in the FIGURE, the increased rate is about double the first or normal rate.

In addition, in the disclosed construction, the predetermined speed is preferable idle speed which is about 2000 RPM, although other speeds could be employed, and the initial predetermined break-in period is about five hours, although other time periods could be employed.

The disclosed method for breaking-in an internal combustion engine comprises the steps of providing an engine component capable of operation under a first rate or condition and under a second rate or condition, determining whether the engine is operating above or below a predetermined speed, determining the cumulative time of engine operation above the predetermined speed, operating the engine component at the second rate or condition during a predetermined initial break-in period of engine operation at speeds above the predetermined speed, and operating the engine component at the first rate or condition either when the engine is operating at speeds below the predetermined speed, or, after the predetermined initial period of engine operation at speeds above the predetermined speed.

In accordance with the method, the engine component can be an oil pump or a fuel pump, the predetermined speed can be idle speed, which can be about 2000 RPM, and the predetermined initial break-in period can be about five hours of engine operation above the predetermined speed. The method also extends to other engine components, to other predetermined speeds, and to other break-in periods.

The determination of engine speed can be based either on actual speed, as by a signal generated from the flywheel 23 or other component rotating at engine speed, or by reference to a throttle setting.

The invention thus provides a method by which various engine management systems are automatically programmed to facilitate a less stressful "break-in" period for the typical newly built two-cycle marine engine.

The invention thus also provides an automatic and initial adjustment of the pertinent engine parameters to provide the engine a gentle break-in period. This could be accomplished by installation of a micro-chip (or whatever) into the engine's electronic control unit (ECU) that will adjust the engine parameters most conducive to the proper break-in. Another variable of the invention is to provide a mode in the ECU that automatically cycles from break-in mode to normal running mode.

This invention is not limited to only two-stroke engines and can be applied to any type of engine on which sufficient electronics are available for control. Furthermore, the engine can be reprogrammed at a dealer or customer level either by replacing an inexpensive electronic component (or resetting a switch) to provide the same break-in period in the event a short block rebuild was required.

The corresponding structures, materials, acts, and equivalents of all means or step plus function elements in the claims below are intended to include any structure, material, or act for performing the function in combination with other claimed elements as specifically claimed.

I claim:

1. A method of breaking-in an internal combustion engine comprising the steps of:

providing an engine component capable of operation under a first rate or condition and under a second rate or condition;

determining whether the engine is operating above or below a predetermined speed;

determining the cumulative time of engine operation above the predetermined speed;

operating the engine component at the second rate or condition during a predetermined initial period of engine operation at speeds above the predetermined speed; and operating the engine component at the first rate or condition either when the engine speed is at or below the predetermined speed, or, after the predetermined initial period of engine operation at speeds above the predetermined speed.

2. The method of claim 1 further comprising the step of providing an oil pump as said engine component.

3. The method of claim 2 further including the steps of:

causing said oil pump to provide a normal oil delivery during said first rate or condition; and causing said oil pump to increase the oil delivery rate during the second rate or condition.

4. The method of claim 1 further comprising the step of setting the predetermined speed as idle speed of the internal combustion engine.

5. The method of claim 4 further including the step of setting the predetermined idle speed at about 2000 RPM.

6. The method of claim 1 wherein the step of operating the engine component at the second rate during a predetermined initial break-in period of engine operation further includes the step of setting the predetermined initial break-in period to be about five hours of engine operation above the predetermined speed.

7. The method of claim 1 further including the step of determining engine speed by reference to a throttle setting.

8. A method of operating an oil pump to deliver oil to an internal combustion engine during break-in, the method comprising the steps of:

providing an oil pump capable of operation so as to deliver oil to the engine at a normal oil delivery rate and at an increased oil delivery rate;

determining whether the engine is operating above or below idle speed;

determining the cumulative time of engine operation above idle speed;

operating the oil pump to deliver oil to the engine at the increased oil delivery rate during a predetermined initial period of engine operation at speeds above idle speed; and operating the oil pump to deliver oil to the engine at the normal oil delivery rate either when the engine speed is at or below idle speed or after the predetermined initial period of engine operation at speeds above idle speed.

9. An internal combustion engine comprising:

an engine component capable of operating under a first rate or condition and under a second rate or condition;

a sensor operable to detect engine speed; and an electronic control connected to the engine component and to the sensor, said electronic control being operable:

(1) to operate the engine component at the second rate during a predetermined initial period of engine operation only at speeds above a predetermined speed; and (2) to operate the engine component at the first rate either when the engine is operating at speeds at or below the predetermined speed or after the initial predetermined period of engine operation at speeds above the predetermined speed;

a comparator operable to determine whether engine speed is above or below the predetermined speed; and a counter operable to determine the cumulative time of initial engine operation above the predetermined speed.

10. An internal combustion engine comprising:

an engine component capable of operating at a normal rate and at an increased rate;

a sensor operable to determine engine speeds; and an electronic control connected to the engine component and to the sensor, said electronic control being operable to:

(1) operate the engine component at the increased rate during a predetermined initial period of engine operation only at speeds above idle speed; and (2) operate the engine component at the normal rate either when the engine is operating at speeds at or below idle speed or after the initial predetermined period of engine operation at speeds above idle speed;

a comparator operable to determine whether engine speed is above or at or below idle speed; and a counter operable to determine the cumulative time of initial engine operation above idle speed.

11. An internal combustion engine comprising:

an oil pump capable of operating so as to deliver oil to the engine under a normal oil delivery rate and at an increased oil delivery rate;

a sensor operable to detect engine speed; and an electronic control connected to the oil pump hand to the sensor and being operable:

(1) to operate the oil pump to deliver oil to the engine at the increased oil delivery rate during a predetermined initial period of engine operation only at speeds above idle speed; and (2) to operate the oil pump to deliver oil to the engine at the normal oil delivery rate either when the engine is operating speed is at or below idle speed or after the initial predetermined period of engine operation at speeds above idle speed;

a comparator operable to determine whether engine speed is above or below idle speed; and a counter operable to determine the cumulative time of engine; operation above idle speed.

12. An internal combustion engine as in claim 11 wherein the predetermined initial period of engine operation at speeds above idle speed is about five hours.

13. The internal combustion engine of claim 11 wherein the increased oil delivery rate of the oil pump is twice the normal rate.

* * * * *